US008365489B1

(12) United States Patent
Bond

(10) Patent No.: US 8,365,489 B1
(45) **Date of Patent: *Feb. 5, 2013**

(54) BUILDING SYSTEM AND METHOD OF CONSTRUCTING A MULTI-WALLED STRUCTURE

(75) Inventor: Art Bond, Plantation, FL (US)

(73) Assignee: Bond Building Systems, Inc., Ft. Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/221,399

(22) Filed: Aug. 30, 2011

Related U.S. Application Data

(63) Continuation-in-part of application No. 12/321,756, filed on Jan. 23, 2009, now Pat. No. 8,006,451, which is a continuation-in-part of application No. 11/156,991, filed on Jun. 20, 2005, now abandoned, which is a continuation-in-part of application No. 10/383,874, filed on Mar. 7, 2003, now Pat. No. 6,907,698.

(51) Int. Cl.
*E04B 2/04* (2006.01)

(52) U.S. Cl. ..... 52/348; 52/344

(58) Field of Classification Search ..... 52/454, 52/342, 344, 348–350, 92.2, 93.2, 127.2, 52/354

See application file for complete search history.

(56) References Cited

U.S. PATENT DOCUMENTS

| | | | | |
|---|---|---|---|---|
| 610,457 | A | 9/1898 | Omeis | |
| 630,141 | A * | 8/1899 | Venezia | 52/241 |
| 670,809 | A * | 3/1901 | Perry | 52/506.1 |
| 706,348 | A | 8/1902 | Simpson et al. | |
| 719,191 | A * | 1/1903 | Collins | 52/348 |
| 799,544 | A | 9/1905 | Dennis | |
| 1,258,409 | A | 3/1918 | Hill | |
| 1,498,182 | A | 6/1924 | Lindsay | |
| 1,530,662 | A | 3/1925 | Gibbons et al. | |
| 1,577,633 | A * | 3/1926 | Collins | 52/250 |
| 1,598,145 | A * | 8/1926 | Lozano | 52/250 |
| 1,779,713 | A * | 10/1930 | Satterlee | 52/350 |
| 1,815,075 | A * | 7/1931 | Sersen | 52/355 |
| 2,087,867 | A * | 7/1937 | Balduf | 52/349 |
| 2,104,869 | A * | 1/1938 | Levy | 52/274 |
| 2,104,873 | A * | 1/1938 | Levy | 52/241 |
| 2,104,875 | A | 1/1938 | Levy | |
| 2,134,155 | A * | 10/1938 | Spinosa | 52/349 |
| 2,184,353 | A * | 12/1939 | Leary | 52/241 |
| 2,208,191 | A | 7/1940 | Kerr | |
| 2,311,951 | A | 2/1943 | Marshall | |
| 2,369,000 | A * | 2/1945 | Page | 52/242 |
| 2,391,960 | A * | 1/1946 | Gede, Jr. | 52/213 |
| 2,540,305 | A | 2/1951 | Tomlinson | |
| 2,827,736 | A | 3/1958 | Estey | |
| 2,969,565 | A * | 1/1961 | Levy | 52/126.4 |

(Continued)

FOREIGN PATENT DOCUMENTS

| | | |
|---|---|---|
| FR | 2 562 581 | 10/1985 |
| JP | 04276404 A * | 10/1992 |

(Continued)

*Primary Examiner* — Christine T Cajilig
(74) *Attorney, Agent, or Firm* — Malloy & Malloy, P.L.

(57) ABSTRACT

A building system including supports vertically disposed in an underlying surface in spaced apart relation, and support headers removably disposed on an exposed end of each of the supports. Each support header includes a mounting hub that removably engages the exposed end of the support. A span element is provided and extends between adjacent supports, each span element including a lock element that matingly engages a corresponding engagement element at the supports to removably secure the span element in position. A reinforcement panel formed of a stiff, open grid configuration is suspended from the span element along with an application panel. The application panel includes apertures defined therein to define an open mesh, and a quantity of unhardened concrete is applied to the application panel to substantially cover the application panel, the reinforcement panel and the supports, thereby defining a wall upon hardening.

21 Claims, 8 Drawing Sheets

U.S. PATENT DOCUMENTS

| | | | | | |
|---|---|---|---|---|---|
| 3,302,343 | A | * | 2/1967 | Bear | 52/98 |
| 3,304,685 | A | | 2/1967 | Whetstone | |
| 3,395,506 | A | * | 8/1968 | Petrig | 52/349 |
| 3,578,732 | A | | 5/1971 | Lount et al. | |
| 3,622,656 | A | | 11/1971 | Dewey et al. | |
| 3,676,973 | A | * | 7/1972 | Kellert | 52/262 |
| 3,802,147 | A | * | 4/1974 | O'Konski | 52/630 |
| 4,052,829 | A | | 10/1977 | Chapman | |
| 4,253,288 | A | | 3/1981 | Chun | |
| 4,327,529 | A | | 5/1982 | Bigelow, Jr. et al. | |
| 4,443,992 | A | | 4/1984 | Shechter | |
| 4,489,530 | A | * | 12/1984 | Chang | 52/745.09 |
| 4,494,353 | A | * | 1/1985 | Lewis | 52/745.19 |
| 4,559,752 | A | | 12/1985 | Kieffer | |
| 4,688,358 | A | * | 8/1987 | Madray | 52/93.2 |
| 4,918,899 | A | | 4/1990 | Karytinos | |
| 5,081,814 | A | | 1/1992 | Singletary et al. | |
| 5,157,887 | A | | 10/1992 | Watterworth, III | |
| 5,218,801 | A | | 6/1993 | Hereford | |
| 5,335,472 | A | | 8/1994 | Phillips | |
| 5,375,381 | A | | 12/1994 | Park et al. | |
| 5,381,633 | A | | 1/1995 | Hendrich | |
| 5,487,242 | A | | 1/1996 | Stafford | |
| 5,697,195 | A | | 12/1997 | Maylon | |
| 5,740,643 | A | | 4/1998 | Huntley | |
| 6,073,404 | A | | 6/2000 | Norfleet | |
| 6,370,835 | B1 | | 4/2002 | Morgan et al. | |
| 6,907,698 | B1 | | 6/2005 | Bond | |
| 8,006,451 | B2 | | 8/2011 | Bond | |

FOREIGN PATENT DOCUMENTS

| | | | |
|---|---|---|---|
| WO | WO 2012/115607 | * | 8/2012 |
| WO | WO 2012/115607 A1 | | 8/2012 |
| ZA | 94/5756 | | 3/1995 |
| ZA | 95/6728 | | 8/1995 |
| ZA | 96/2092 | | 11/1996 |

* cited by examiner

BUILDING SYSTEM AND METHOD OF CONSTRUCTING A MULTI-WALLED STRUCTURE

CLAIM OF PRIORITY

The present application is a continuation-in-part application of previously filed patent application having Ser. No. 12/321,756, filed on Jan. 23, 2009, which matures into U.S. Pat. No. 8,006,451 on Aug. 30, 2011, which is a continuation-in-part application of previously filed, now abandoned application having Ser. No. 11/156,991, filed on Jun. 20, 2005, which is a continuation-in-part application having Ser. No. 10/383,874, filed on Mar. 7, 2003, which has matured into U.S. Pat. No. 6,907,698 on Jun. 21, 2005, all of which are incorporated herein in their entireties, by reference.

BACKGROUND OF THE INVENTION

1. Field of the Invention

The present invention relates to a building system and method for constructing a multi-walled structure, configured to rapidly construct a multi-walled structure at almost any location, in a manner which achieves strong, rigid walls, having identifiable strength quotients so as to permit the construction of regulated building structures and the appropriate incorporation thereof into engineering and architectural plans. Moreover, the present building system and method is substantially economical to utilize and incorporates a plurality of reusable, easy to transport and manipulate components, while benefiting from direct concrete application techniques that can be achieve quickly and at low cost in the field.

2. Description of the Related Art

The construction of economic and/or affordable housing and/or other building structures is of paramount importance in virtually every society. Unfortunately, however, of equal importance is the endurance that all building structures are fabricated to certain minimum standards and specifications so as to provide a safe dwelling and/or other facility which can withstand multiple loads and stresses, such as from the elements, acts of nature, normal wear and tear and/or construction stresses.

Although a large number of building structures are still formed from steel and/or wood framing, with the inclusion of cinder blocks and/or molded, poured concrete elements, those traditional manufacturing techniques are often expensive, time consuming and may not be practical in a variety of circumstances and/or at a variety of locations. Indeed, it is recognized that based on the ever increasing cost of construction, many building structures are often formed in what may be considered a prefabricated and/or modular type of manner. For example, large wall slabs are often precast at an appropriate, remote location, and those precast slabs are transported to the construction site and appropriately erected, as needed, by various types of machinery. As a result, relatively strong building structures can be defined in a somewhat rapid and cost effective manner. Regrettably, however even such manufacturing techniques can often prove costly in certain circumstances, and are typically only practical when forming large facilities, wherein heavy duty framing can be installed, and more importantly wherein large heavy duty equipment can have access so as to appropriately position the preformed slabs. As a result, a large segment of the construction field, such as in remote and/or harder to reach locations and/or in connection with smaller facilities and tighter budgets, cannot truly benefit from such prefabricated building techniques.

To this end, others in the art have strived to define a variety of different, low cost and economical techniques to construct building structures. In particular, such techniques seek to deviate from traditional uses of brick and mortar, and/or concrete blocks, etc. so as to define a wall structure, and typically require large amounts of manual labor. One such technique that has been recently developed incorporates the application of concrete, such as by a pressurized spray, to a mesh, thereby defining an appropriate wall. While substantial benefits have been derived from such techniques, a large room for improvement still remains. For example, existing construction systems of this type are often difficult and/or complicated to set up, and require extensive and expensive framing materials to be positioned and define portions of the finished wall. Furthermore, such traditional techniques often rely on a flimsy mesh panels to which applied concrete may adhere, but do not truly provide a significant degree of strength and/or reinforcement to the wall structure, let alone verifiable strength and tolerances figures for one wall as compared to another wall manufactured utilizing the same technique. As a result, it would be highly beneficial to provide a building system and method which can be quickly and easily set up for the appropriate application of concrete and which provides properly defined and uniformly formed walls in an economical and minimally labor intensive manner. Moreover, it would be beneficial for such a technique to provide uniform and readily identifiable reinforcement and strength characteristics to the wall structure, thereby providing a strong and durable wall with consistent strength characteristics throughout an entire construction. Also, such a system should not be limited to a formation of straight wall segment, but should be able to achieve appropriately positioned corner elements, including interior and exterior corner elements extending in two or more different directions.

SUMMARY OF THE INVENTION

The present invention relates to a building system which is preferably utilized for the construction of a multi walled facility. Specifically, the building system includes at least two, but typically a plurality of supports. The supports are structured to be vertically disposed in an underlying surface in spaced apart relation from one another, and appropriately secured in place.

A support header is further provided. In particular, a support header is structured to be removably disposed on an exposed end of each of the supports that have been previously disposed in the underlying support surface. Preferably, the support headers each include a mounting hub that removably engages the exposed end of the supports, such that after construction of a wall section and/or the entire structure, the support header can be substantially easily removed from its engaged relation with the supports, and reused at a subsequent location.

The support headers are structured to receive and removably engage and retain a span element. Specifically, a plurality of span elements are preferably provided, each span element structured to extend between adjacent ones of the supports, and including a corresponding lock element. The lock elements, which are preferably disposed at least at opposite ends of each span element, matingly engage engagement elements further provided at the corresponding support headers of adjacent supports. Morever, the lock elements of the span elements and the engagement elements of the support headers preferably removably engage one another, thereby achieving effective and appropriate aligned positioning of the span elements between the adjacent supports, but also allowing for appropriate removability of not only the support headers, but also the span elements for subsequent reuse.

Suspended from each of the span elements is a reinforcement panel. The reinforcement panel is generally stiff and includes an at least partially open configuration. Furthermore, an application panel is also provided and is structured to be suspended from the span element in generally confronting relation to the reinforcement panel. The application panel preferably includes a plurality of apertures defined therein and is structured to receive a quantity of concrete thereon. In particular, unhardened concrete is applied, either manually and/or through mechanical means to the surface of the application panel in order to substantially cover the application panel, the reinforcement panel and the supports, and thereby define a wall upon hardening.

Preferably utilizing a preceding system, the present invention further relates to a method for constructing a multi walled structure. In a first embodiment, the method comprises the opening and/or defining of at least three holes in an underlying surface and the securement of a rigid support in a vertical orientation within each of those holes. A support header can then be placed on the exposed end of each of the rigid supports, and a span element is appropriately positioned to span adjacent ones of the rigid supports, engaging the correspondingly positioned support headers. A header cap or engagement element is then positioned in an engaging relation with the adjacent span elements, as well as the support header, which they both correspondingly engage, thereby effectively maintaining a secure positioning and alignment of the span elements relative to one another.

With the span elements in place, at least one application panel is suspended from each of the span elements, and a pair of reinforcement panels are further suspended from each of the span elements in sandwiching relation to the application panel. With all of the panels in place, a quantity of concrete is then applied to at least the application panels, the concrete being applied from the underlying surface up to the span element so as to effectively cover the application panels, the reinforcement panels and the rigid supports. The concrete is then allowed to harden so as to define a wall, and finally, the header caps, span elements and support headers are effectively removed from the formed wall for subsequent reuse as needed.

These and other features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
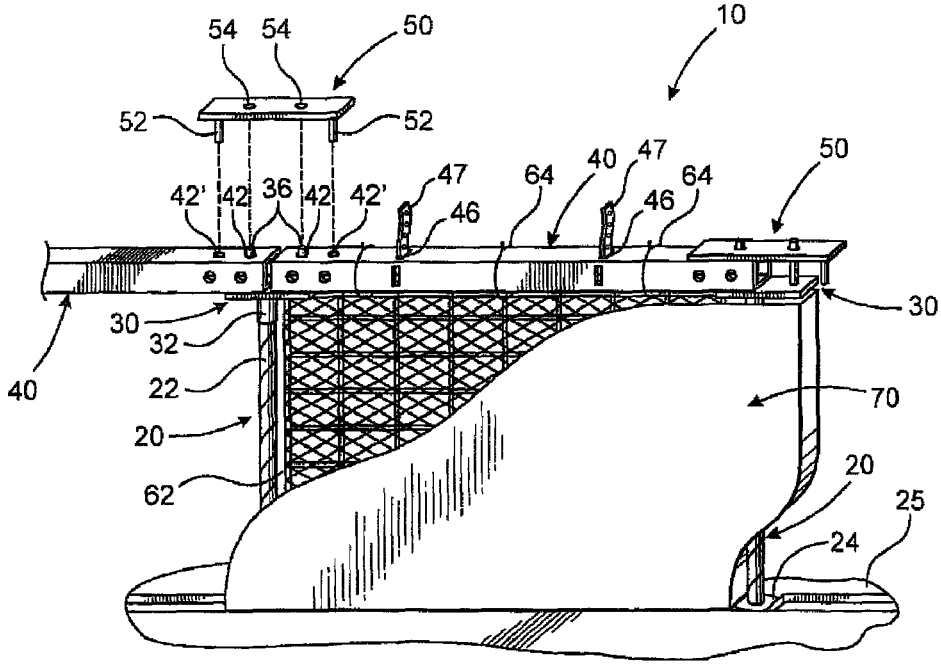
FIG. 1 is a partial perspective illustration of a wall surface fabrication utilizing the building system and method of the present invention.
Figure 5:
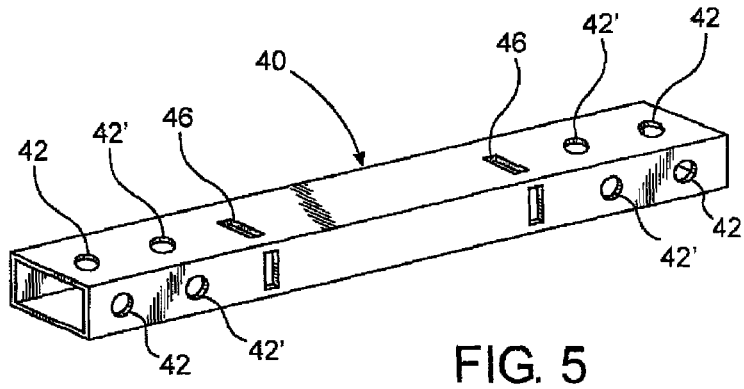
FIG. 5 is an isolated perspective view of one embodiment of the span element utilized within the building system and method of the present invention.

Shown throughout the Figures, the present invention is directed towards a building system, generally indicated as 10. In particular, the building system 10 is structured to be substantially rapid and easy to implement in a cost effective manner so as to form a preferably multi-walled structure which has substantial strength and durability despite its low cost and rapid deployment. Furthermore, the present building system 10 is specially structured to facilitate rapid and easy construction in a variety of locations including locations wherein heavy equipment cannot necessarily be utilized.

As illustrated in the Figures, the present building system 10 includes at least two, but often a plurality of more than two supports 20. The supports 20 are preferably substantially rigid, and may be formed from any variety of strong, durable rigid materials, but preferably iron or steel. Moreover, the thickness and/or dimensions of the supports may correspondingly vary, however, a standard ¾ inch to 1 inch diameter may be sufficient in a majority of cases, and to this end, and in order to maximize the economics of the overall construction, standard and/or conventionally available materials, such as rebar type rods are preferably utilized.

The supports 20 are structured to be vertically disposed into an underlying surface 25 in spaced apart relation from one another, and are preferably effectively and substantially permanently secured into the underlying support surface 25 in a vertical, upstanding orientation. To this end, the overall height of these supports 20 may vary depending upon the desired height of the wall section to be formed above the underlying surface 25. Furthermore, the underlying surface 25 may be dirt or soil, or may be concrete or any other material which may make a foundation or even an underlying base for a subsequent foundation of a building structure. As a result, it may be preferred that a hole 24 be made in the underlying surface 25 into which the support 20 can be inserted, and then subsequently secured, such as by pouring concrete into the hole 24 and thereby fixing the support 20 in place.

Looking further to the number of supports 20 which may be utilized, for purposes of clarity when reference is made herein to the present invention, a wall section may be defined as the section between a pair of spaced apart, yet adjacent supports 20. Nevertheless, it is recognized that more than two supports may be utilized to define a single wall section of larger or smaller size, and the beginning and/or ending of a wall section need not necessarily be determined by a change in direction of that wall section. As indicated, however, for purposes of clarity a wall section may be defined between adjacent ones of a pair of supports 20.

Figure 7:
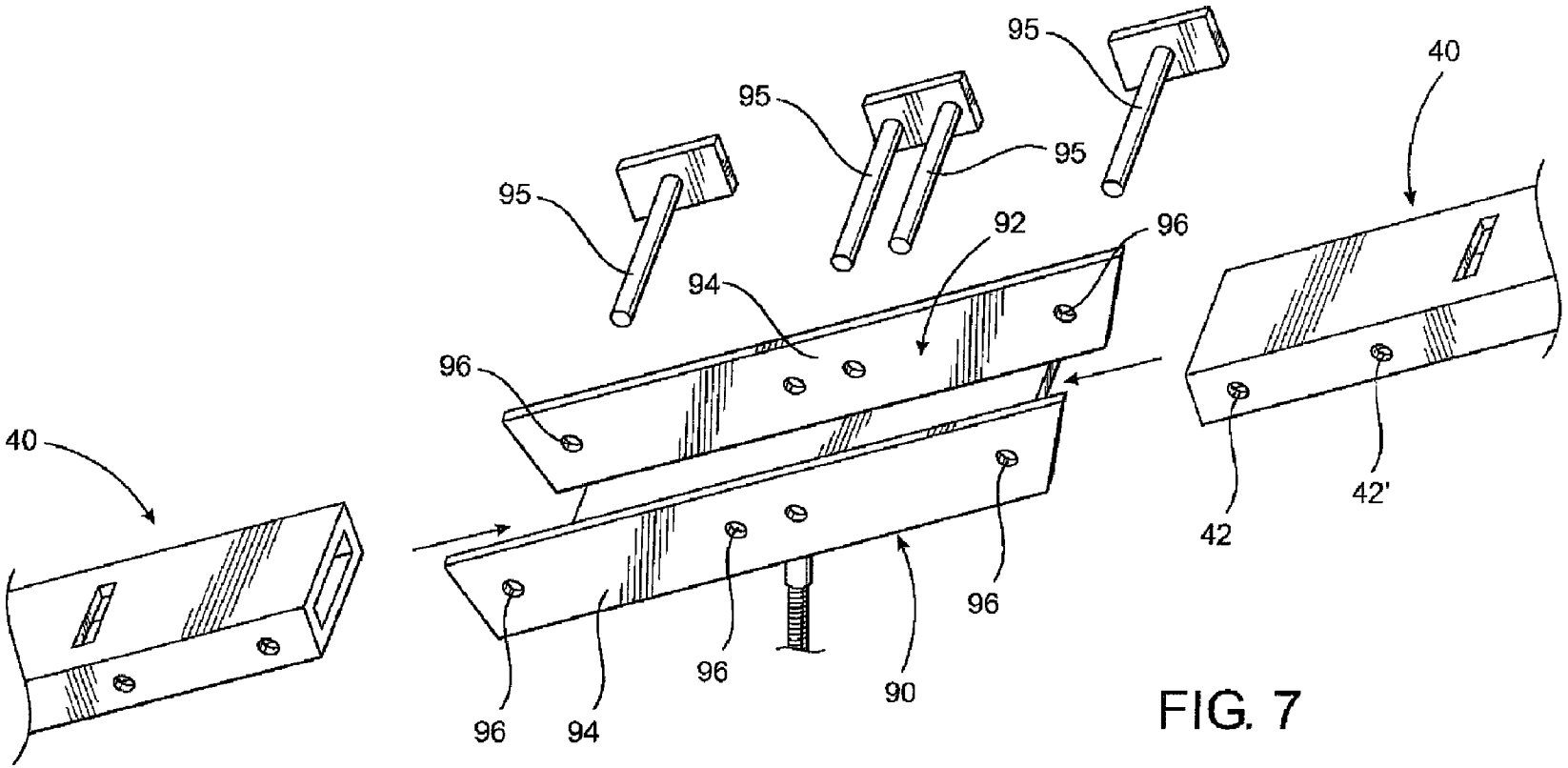
FIG. 7 is an exploded perspective view of an alternate embodiment of the support header.

The building system 10 of the present invention further includes at least one, but typically a plurality of support headers 30, 30', 30", 90, 90', 90", 190, 190', 190". In particular, the support headers 30, 30', 30", 90, 90', 90", 190, 190', 190" may be structured to be removably disposed on an exposed end 22 of each of the supports 20 or on or interlocked with another support header. Furthermore, as will be described in greater detail subsequently, the support headers may include a standard linear support header 30 or 90, as illustrated in FIGS. 1 and 7 and/or a corner support header 30', 30", 90' or 190' as illustrated in FIGS. 2, 8, 9 and 10, or a roof truss header 90", 190 or 190" as in FIGS. 8, 11 and 12. Looking in further detail, however, to the positioning of the support headers 30, 30', 30", 90, 90', 90", 190, 190', 190" on the supports, each preferably includes a mounting hub 32 that removably engages the exposed end 22 of the support 20. In this regard, the mounting hub 32 may include any of a variety of configurations and/or structures which provide for effective securement and positioning of the support header 30, 30', 30", 90, 90', 90", 190, 190', 190" on the exposed end 22 of the support 20. In the preferred embodiment, the securement to the support 20 is removable and moreover, in the illustrated embodiment the mounting hub 32 preferably includes a socket 31 into which the exposed end 22 of the support 20 may be effectively introduced, such as in an axial manner. As a result, the support header 30, 30', 30", 90, 90', 90", 190, 190', 190" can be effectively fitted over the end of the support 20, with the support 20 effectively secured in the underlying surface 25, in order to achieve an appropriate vertical structure that preferably stands on its own. Of course, it is noted that as for the roof truss header 90" and 190", it may be configured with a mounting hub for direct positioning on a support 20, or as in the illustrated embodiment, for indirect securement with the support by positioning within the corner support header 90' or 190'.

Figure 4:
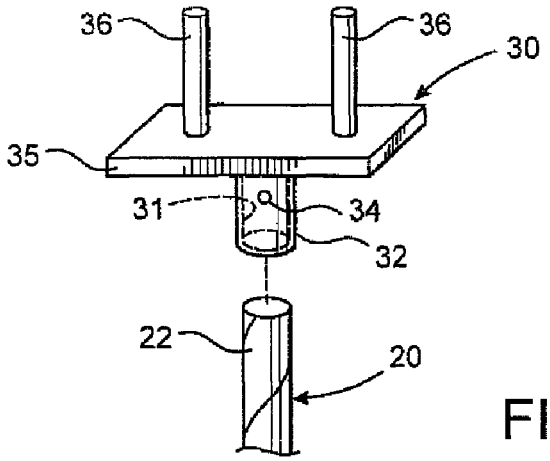
FIG. 4 is an isolated view of one embodiment of the support header utilized within the building system and method of the present invention.
Figure 6:
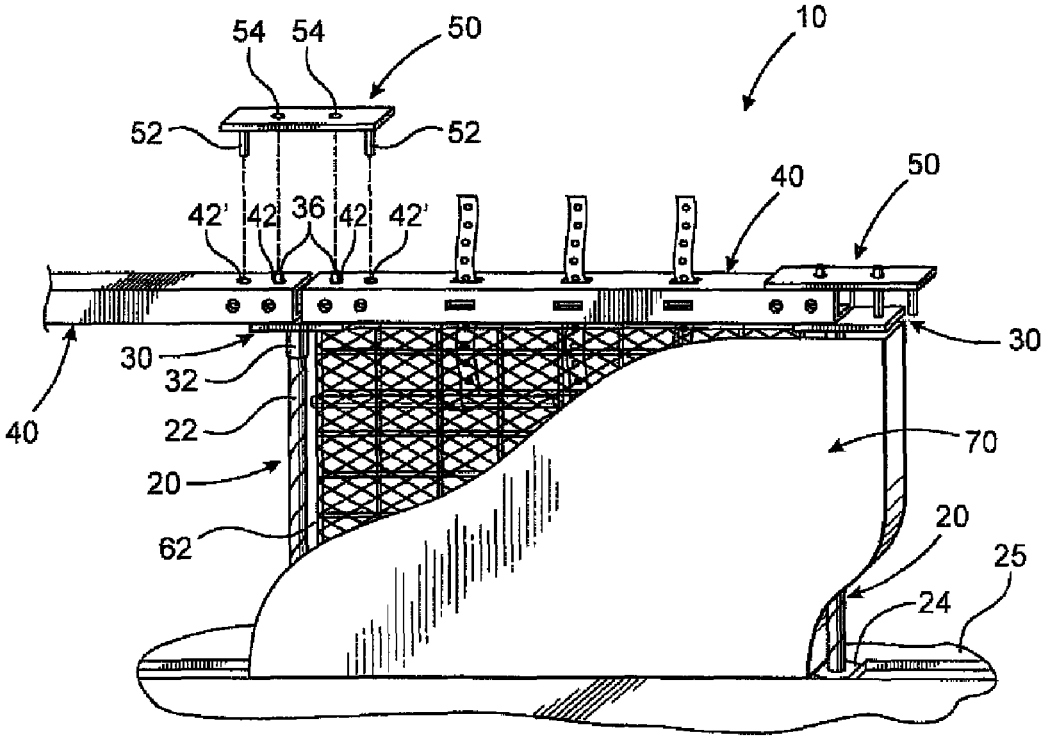
FIG. 6 is a partial perspective illustration of a wall surface fabrication utilizing the building system and method of the present invention wherein the roof straps suspend the panels in place.

As indicated, the support header 30, 30', 30", 90, 90', 90", 190, 190', 190" is preferably removable subsequent to formation of the wall, as will be described. As such, it is preferred that the mount hub 32, and in particular the socket configuration include a rounded exterior surface. In this manner, even when encased in concrete, a twisting of the support header 30, 30', 90, 90', 90", such as with the aid of some force or an impact, can effectively disengage the mount hub 32 from an embedded orientation within the concrete of the formed wall section, providing for removal from the support 20. In such an embodiment, the resultant hole may be filled with small quantities of concrete in order to seal the opening and further define the wall section. Additionally, preferably disposed within the socket 31 of the mounting hub 32 is a spacer element 34 as represented in FIG. 4. In particular, the spacer element 34 is preferably secured to the support header 30, 30', 30", 90, 90', 90", 190, 190', 190" and helps to achieve some spacing of the support header 30, 30', 30", 90, 90', 90", 190, 190', 190" above the end of the support 20.

In addition to the mounting hub 32, each support header 30, 30', 30", 90, 90', 90", 190, 190', 190" also preferably includes one or more engagement elements. In particular, in a first illustrated embodiment, the support headers 30, 30', 30" may include a frame member 35 that is preferably positioned atop the mounting hub 32 so as to generally define a platform. Disposed preferably on and extending outwardly from the vertical platform 35 are one or more engagement elements 36. Specifically, the engagement elements are structured to effectively and securely engage a span element 40 further included as part of the present building system 10. Preferably, the present building system 10 includes one or more span elements 40. These span elements 40 are preferably formed from a substantially strong, rigid material construction, and may include a hollow and/or solid tubular configuration. Furthermore, the span elements 40 are preferably structured to extend from one support 20 to an adjacent support. In this regard, it is recognized that a single span element 40 may extend between a plurality of supports 20. However, for purposes of clarity and explanation, a description relative to the spanning of only a pair of spaced apart supports 20 will be described. Furthermore, in the preferred, illustrated embodiment, the span element may include a rectangular cross section such that changing the orientation of the span element 40 may change a thickness of the wall to be produced in the manner described. For example, the span element may have a 3 inch by 4 inch dimension so as to allow for a 3 inch or 4 inch wall thickness guide to be defined.

In order to effectively secure and position the span elements 40 in spanning relation between adjacent supports 20, each span element preferably includes at least one lock element 42, and typically at least one lock element 42 disposed at opposite ends thereof. These lock elements 42 are preferably, but not necessarily, in the form of apertures and are structured to engage the engagement elements 36 at the support headers 30, 30', 30", 90, 90', 90", 190, 190', 190" in order to achieve effective interlocking, yet removable engagement therebetween. Looking to the first illustrated embodiments of the present invention, the engagement elements 36 of the support headers 30, 30', 30" preferably include rigid shaft segments which extend upwardly from the platform 35 of the support headers 30, 30', 30". Correspondingly, the lock elements 42 of the span elements 40 are preferably defined by correspondingly disposed apertures which are structured to be fitted over the engagement elements 36 so as to achieve effective interlocking engagement therebetween. Furthermore, the apertures may be defined in all faces of the span element 40 so as to allow for alternate positioning of the span element. It is also recognized that although such a configuration of the engagement element 36 and lock element 42 is preferred, alternate configurations may also be equivalently utilized to achieve interlocking, including the inclusion of a rigid shaft segment depending from the span element 40 into a corresponding aperture associated with the support header 30, 30', 30". Nevertheless, viewing the first illustrated embodiment preferably an aperture 42 is defined at each end of the span element 40 to engage one of the engagement elements 36 on each corresponding support header 30, 30', 30" thereby effectively providing for interlocking therebetween. Furthermore, although it is recognized that a pair of engagement elements 36 may be provided to engage each end of a single span element 40, thereby prevent twisting and/or pivoting therebetween, in the illustrated embodiment and as will be described subsequently, only a single engagement element 36 and lock element 42 need engage one another to provide for effective securement. As a result of this configuration, and as illustrated in FIG. 1, the span elements 40 may be effectively disposed in an end-to-end relation to one another, wherein a pair of span elements 40 engage a single support header 30 in a linear and/or slightly angled configuration.

Figure 2:
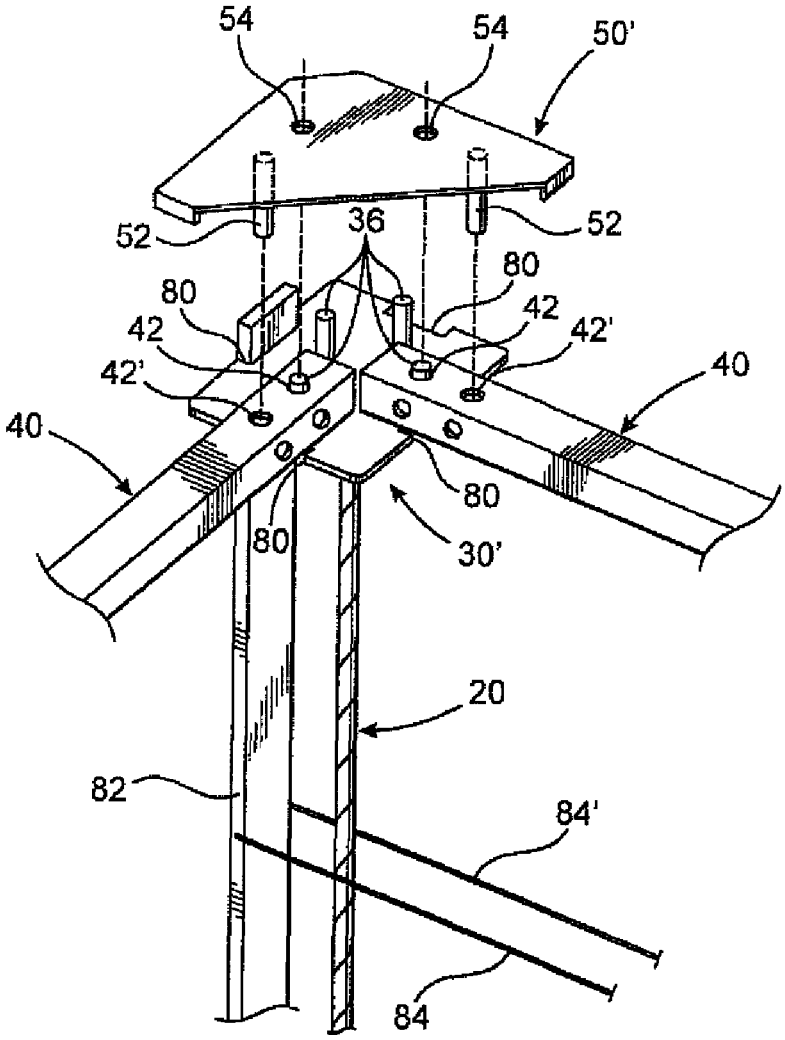
FIG. 2 is an exploded, partial perspective view of a corner construction utilizing the building system and method of the present invention.
Figure 3:
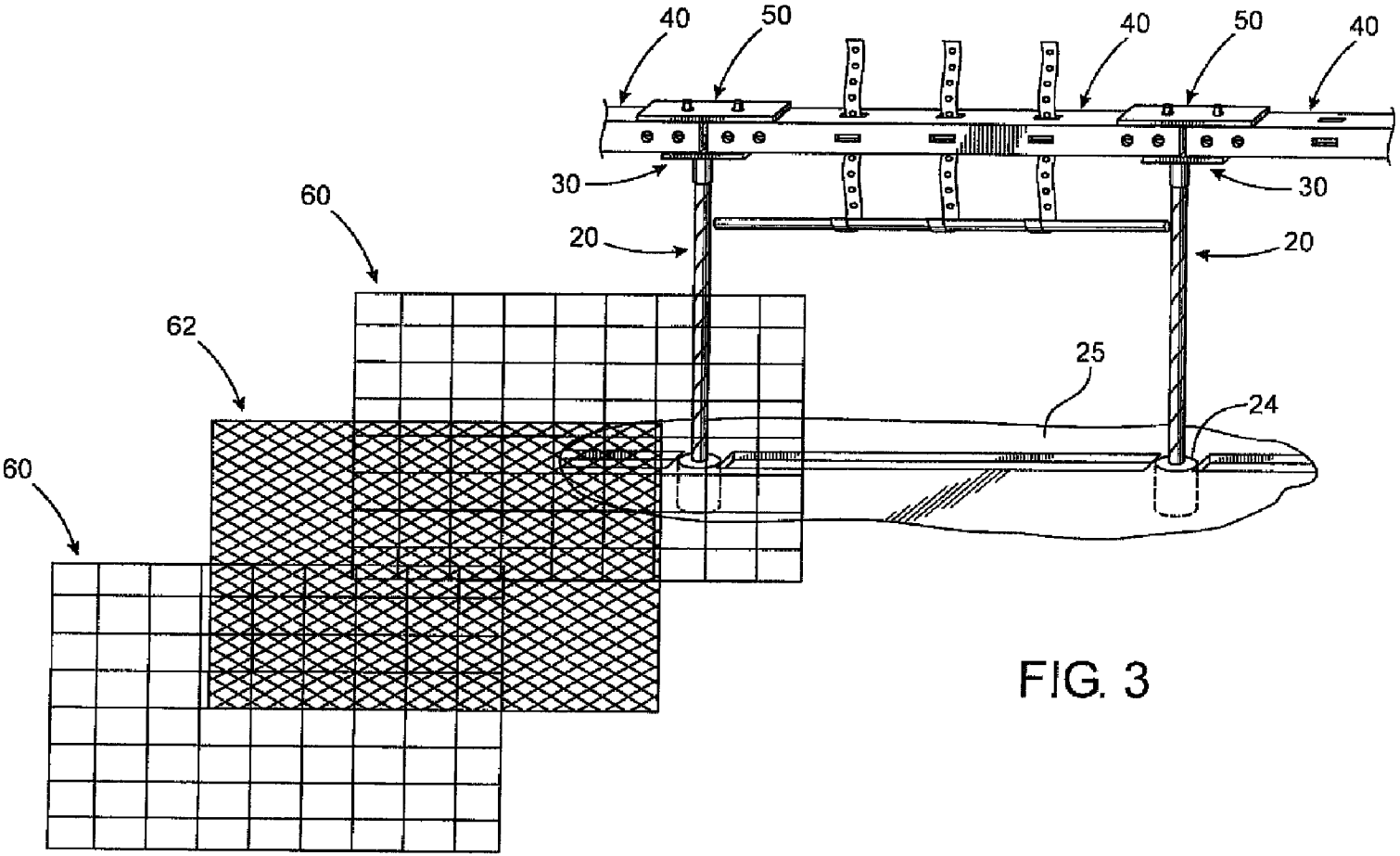
FIG. 3 is an exploded perspective illustration of the various material panels preferably utilized in connection with the present building system and method.

Turning FIG. 2, however, and as previously recited, it is also understood that the support header 30 may further include a corner support header 30' or 30". In such an embodiment, the engagement elements 36 may be slightly off set from one another and may be positioned so as to allow span elements 40 to extend from the corner support header 30', 30" in different directions from one another, and in many embodiments at generally a 90 degree angle relative to one another. In this regard, although it is preferred that at least two engagement elements 36 be provided on the corner support header 30', 30" as with the other embodiments of the support header 30, it is also noted that in such an embodiment a larger number of engagement elements 36, such as three or four engagement elements may be effectively provided at the corner support header 30, 30'". As such, the span elements 40 may extend away from the corner support header 30' in virtually any direction, including making a four corner type wall section using 30' or 30", and/or merely making a 90 degree wall corner that may go in any direction.

Utilizing the first illustrated structure of the engagement elements 36 and lock elements 42 between the support headers 30, 30', 30" and the span elements 40, it is recognized adjacent span elements 40 secured at the same support header 30, 30', 30" may be pivoted at virtually any angle relative to one another. While the securement of the opposite ends of the span element 40 at the support header 30, 30', 30" on an adjacent support 20 will effectively serve to define a relative angle and/or orientation of adjacent span elements 40 to one another, in these illustrated embodiments a corresponding header cap 50, 50' is preferably provided for each support header 30, 30'. In particular, the header cap 50, 50' is preferably structured to engage each of the two or more adjacently disposed span elements 40 at the support header 30, 30', 30" as well as to effectively engage the support header 30, 30', 30" itself. In that manner the relative orientation of the adjacent span elements 40 can be effectively secured and a substantial degree of stability can be maintained while the construction process is completed. Looking to FIG. 1, the header cap 50 may include a linear header cap such as in the form of adjacent, and end to end wall sections, or as illustrated in FIG. 2 may include a corner header cap 50' which can appropriately secure and maintain the adjacent span elements 40 in a desired angled orientation relative to one another. Although a variety of different modes of engagement may be effectively achieved between the header cap 50, 50' and the span elements 40 and support headers 30, 30', 30" with regard to the first illustrated embodiments of the engagement elements 36 and lock elements 42, it is preferred that the header caps 50, 50' be configured with at least one but preferably a pair of apertures 54 as well as a pair of downwardly depending shaft segments 52. Specifically, the apertures 54 on the header cap 50, 50' are preferably structured to receive the distal ends of the engagement elements 36 of the support header 30, 30', 30" subsequent to their passage through the lock element 42 of the span elements 40. Additionally, however, each of the span elements 40 preferably also includes an additional pair of apertures 42' spaced apart from the lock elements 42. This additional set of apertures 42' is preferably configured so as to receive the downwardly depending shaft segments 52 of the header caps 50, 50' therethrough. As a result, an effective and sturdy securement of adjacent span elements 40 relative to one another can be appropriately achieved in a substantially quick and rapid manner, once the concrete footer at the base of each support 20 has hardened.

Turning to FIGS. 7, 8, 11 and 12, alternate embodiments of the support header 90, 90', 90", 190, 190', 190" are illustrated. In these embodiments the support header 90, 90', 90", 190, 190', 190" includes at least one recess 92 into which a span element 40 extends. Each recess 92 is preferably defined by at least one wall element 94, that wall element also serving to define part of the engagement element that removably secures the end of the span element to the support header. Preferably, however, a pair of wall elements 94 are provided to define each recess 92, and the recess 92 may be oriented in any desired direction dependent upon the desired direction of the wall segment to be formed. For example, in the case of a standard support header 90, a pair of linearly aligned recesses 92, which may or may not be separated from one another by an interior wall, are preferably included such that the ends of adjacent span elements can be supported therein to make adjacent linearly aligned wall sections. Conversely, in the case of the corner support header 90', 190' two or more recesses 92 are preferably defined, at least two of those recesses 92 preferably angled relative to one another so as to define generally perpendicular and/or angled wall segments. In this embodiment of the corner support header 90' a third recess can be provided so as to facilitate forming a generally perpendicular or angled wall segment between two adjacent linear wall segments. Furthermore, a fourth recess 92 can be provided for the formation of a four corners region. Naturally, two or more recesses can be defined in a particular corner support header 90', 190', with only the desired number of recess being utilized depending upon the needs of a structure. As such, the corner support header 90", 190' can be used in most sections of a structure merely by selectively placing a span element 40 as needed.

Figure 8:
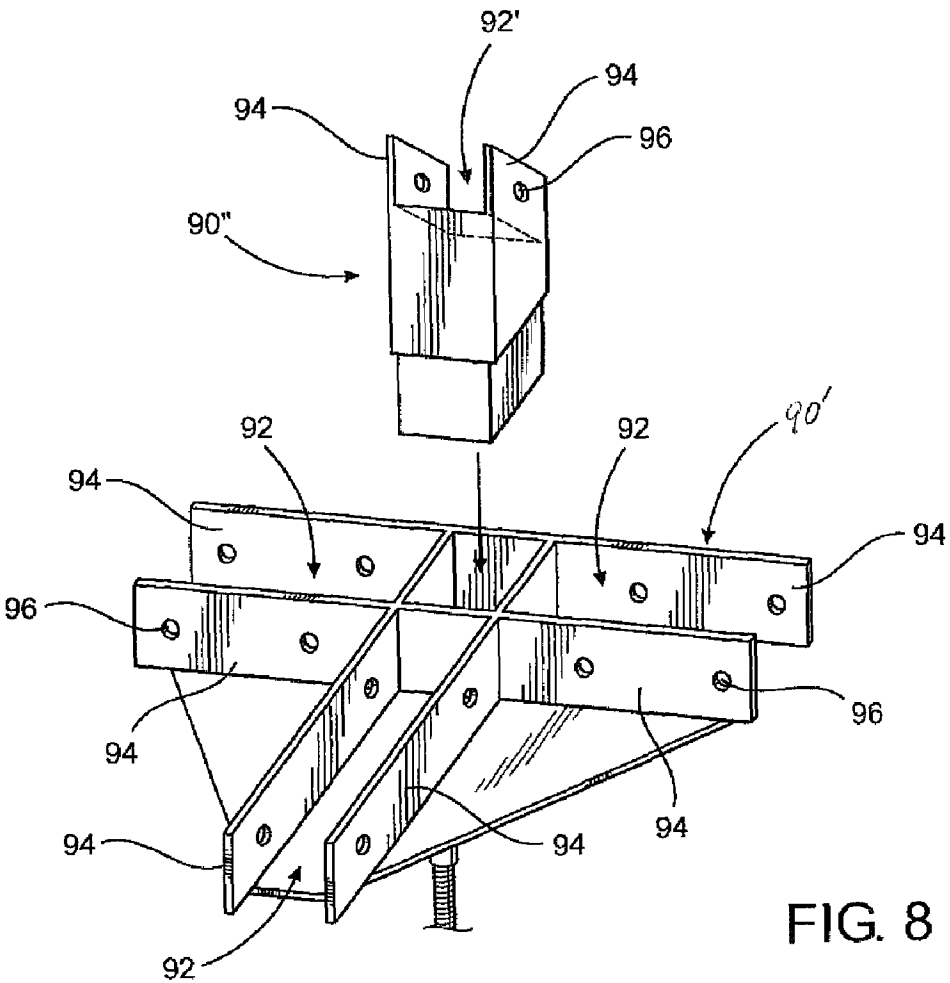
FIG. 8 is an exploded perspective view of an alternate embodiment of the corner support header and roof truss support header.
Figure 9:
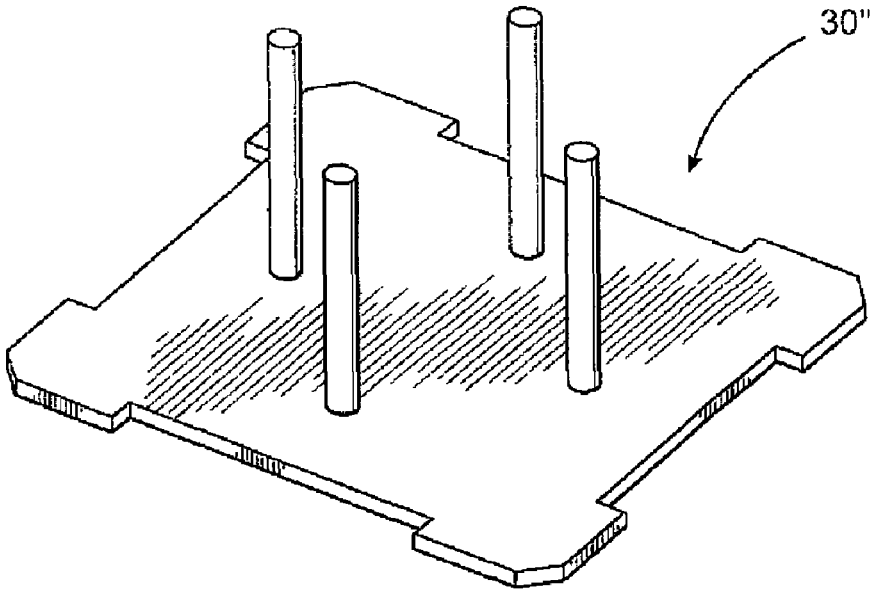
FIG. 9 is a perspective view of cross support header to be disposed at a point where beams intersect.
Figure 10:
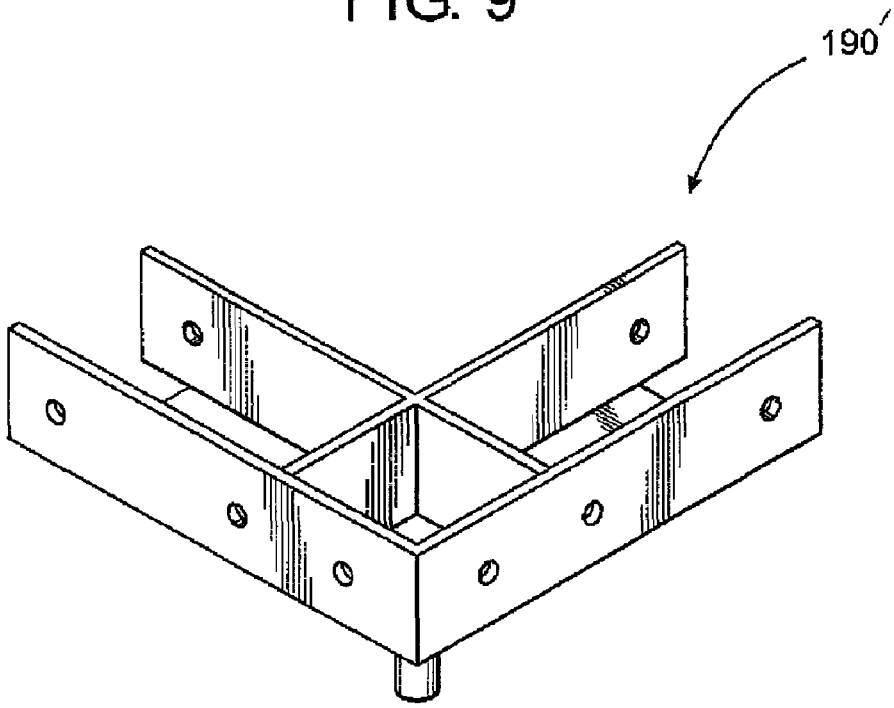
FIG. 10 is a perspective view of an alternate corner support header.
Figure 11:
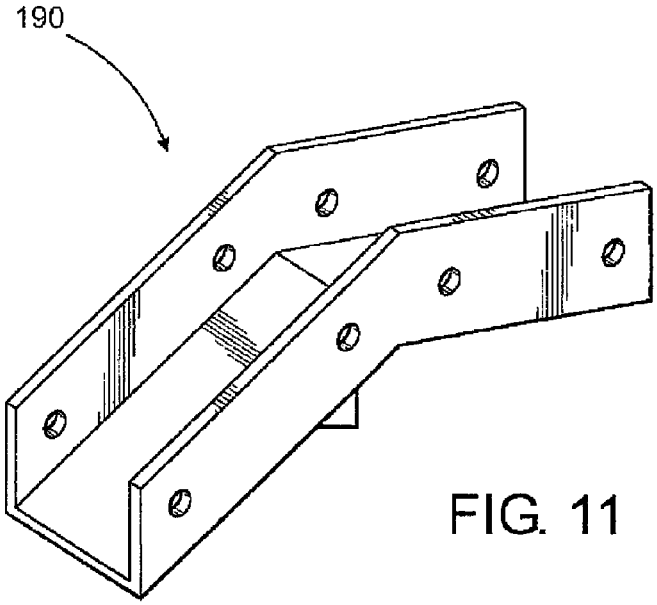
FIG. 11 is a perspective view of a roof truss apex support header to be disposed at the peak of a roof section.
Figure 12:
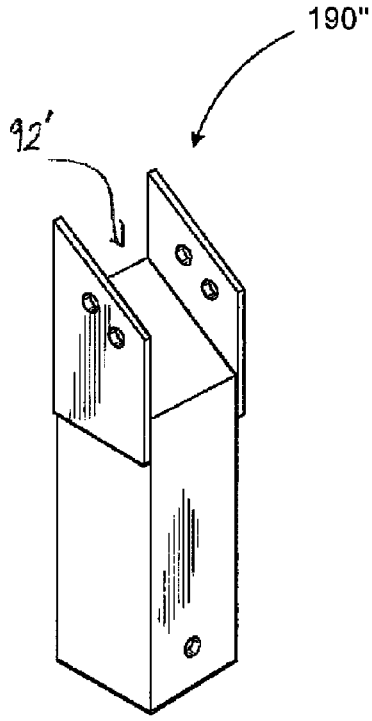
FIG. 12 is a perspective view of an alternate roof truss header.
Figure 13:
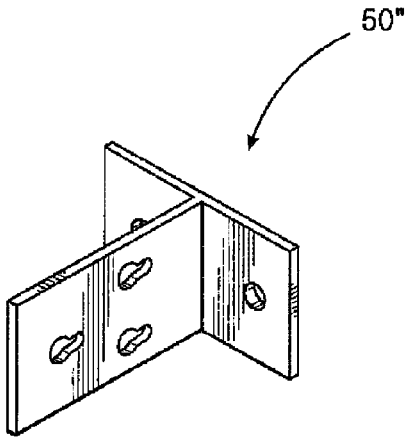
FIG. 13 is a perspective view of a connector header cap disposed as a header to which a beam or other element may be secured.

Continuing with regard to FIGS. 8, and 12, the roof truss support headers 90" and 190" preferably include an angled or sloped recess 92' therein. The angle or slope of the recess 92' allows a span element 40 or other roof truss element to be placed at a desired angle, when it is connected to the roof truss support headers 90" and/or 190". The roof truss support header 190" can be used independently of or in combination with a corner support header 90' and/or 190', or within the standard support header 90 and/or between adjacent span elements 40, independently of additional headers. Furthermore, the height and orientation of the slope can vary to meet the roofing needs of a specific structure. It is also noted that multiple sloped and non-sloped recesses can be provided, such as at a central apex of a roof structure wherein a span element 40 is angled upwardly and an adjacent span element 40 is angled straight or downwardly. An alternate roof truss apex support header 190, as shown in FIG. 11, can also be used.

The versatility of the present invention is further demonstrated by the ability to utilize the roof truss support headers 90' and/or 190' in the formation of a gable roof specifically including, but not limited to, the formation of a gable wall or gable end associated with the gable type architecture and the gable roof construction. More specifically, the angled orientation of the recess 92' and the operative disposition of the roof truss support headers 90" and/or 190" can be used to position a span at a preferred angled orientation during the formation of the gable wall or gable end. In doing so the span is angularly oriented to support the reinforcement and application panels 60 and 62 respectively along the upper periphery of the gable wall being formed. From such an angled span, the application panel 62 and the one or more reinforcement panels 60 can be suspended and configured to facilitate the formation of the substantially triangular or cooperatively angled upper periphery of the gable wall or gable end.

In addition, the roof truss support header 90" and 190" can also be operatively positioned either independently in combination with other headers such as in combination with an appropriate corner header 90'. As such, the roof truss support header 90" and 190" may be disposed and structured to operatively support and/or position an appropriately angled roof truss, which may or may not be associated with a gable roof, as generally set forth above.

As previously mentioned, in the embodiments including a recess 92, 92' defined by one or preferably a pair of wall elements 94, the wall elements may be seen as defining all or part of the engagement elements as they serve to removably retain the ends of the span elements 40. Additionally, however, one or more rigid shaft segments 95 are also preferably provided and define the engagement elements. Specifically, each of the wall elements 94 preferably includes one or two apertures 96 defined therein, such that the rigid shaft segments 95 extend there through. More over, these apertures are preferably aligned with the apertures that define the lock elements 42, 42' in the span elements 40. As such, the rigid shaft segments 95 preferably pass through both apertures 96 and 42, 42' to effectively secure the span elements 40 to the support headers 90, 90', 90", 190, 190', 190".

Preferably suspended from each of the span elements 40 are one or more panels. In particular, in the preferred, illustrated embodiments one or more reinforcement panel(s) 60 are preferably secured in a suspended orientation beneath the span element 40. Each reinforcement panel 60 preferably includes an at least partially open configuration and is formed of a strong, generally stiff material. For example, an open mesh or grid of rigid metal strands or fibers may be appropriate, and in a preferred embodiment 6×6, no. 10 road grade mesh may be preferred. Of course, it is recognized that the reinforcement panel 60 may be formed of a variety of materials, however, a metal is preferred for strength and/or durability, and a standard gage is preferred so that readily identifiable strength characteristics can be associated to its reinforcement of the wall section. Moreover, when multiple reinforcement panels 60 are used, they are preferably offset from one another such that the openings defined therein are not necessarily lined up exactly. Furthermore, each reinforcement panel 60, which as indicated is suspended from the span elements 40, may be secured in any of a variety of fashions including hooks, latches, magnets, clips, etc. In the illustrated embodiments a roofing strap or a series of wire loops 64 are provided for quick and easy looped fastening about the span element 40.

Further suspended beneath each span element 40 is preferably at least one application panel 62. Specifically, the application panel 62 preferably includes a plurality of apertures defined therein, and may also be formed of a mesh type configuration, such as from an expanded metal that may be smooth or contoured. In this regard, it may be preferred that the construction of the application panel 62 be such that the apertures defined therein be somewhat closely spaced relative to one another. In particular, the present invention further comprises a quantity of unhardened concrete 70 which is to be applied at the application panels 62 in order to ultimately define the wall. As a result, by including an open configuration with preferably somewhat small, tightly spaced apertures, effective application of the concrete can be achieved. Further, a reinforcement panel 60 may preferably be disposed on opposite sides of the application panel 62, and the quantity of concrete 70 is preferably applied from both sides in order to define a wall segment.

Although manual application of the unhardened concrete may be effectively achieved, in the preferred embodiment a pressurized application of unhardened concrete in a spray type fashion is preferred. Based upon a structure and configuration of the application panel 62 and the reinforcement panels 60, however, quantities of concrete can pass therethrough, yet still substantially adhere, at least to the application panel 62, so as to give thickness to the wall segment and provide for a substantially solid layer of concrete 70 throughout. As mentioned, once the concrete 70 has been applied from one side, if necessary, a further quantity of concrete can be applied from an opposite side in a similar fashion so as to appropriately define the wall segment. Moreover, if desired, once the concrete is applied, smoothing can be achieved by a user, such as using a trowel or similar type of smoothing process. Nevertheless, in the preferred embodiment the unhardened concrete is preferably applied to extend from the underlying surface 25 up to at least a top of the panels 60, 62 and/or up to the span element 40. It is, however, preferred that the span element 40 not be completely covered in order to permit its subsequent removability.

In order to achieve a substantial degree of uniformity as to the thickness of the wall segment that is defined utilizing the building system 10 and method of the present invention, each corner support header 30', 30" preferably includes one or a plurality of guide segments 80 defined therein. In particular, the guide segments may include one or a series of single or multi-sized notches. Although a single guide segment 80 may be sufficient, in the preferred embodiment, the corner support header 30', 30", 90', 190' may include a guide segment 80 on all faces thereof so as to facilitate usage of a specific corner support header 30', 30", 90', 190' at generally any corner of a building structure to be defined. The guide segments 80 are structured to engage and maintain a vertical guide locator 82 appropriately vertically aligned. The vertical guide locator 82 preferably includes a substantially rigid segment which in the illustrated embodiments may include a section of the span element 40 and/or a piece of lumber, such as a standard 2×4. With the vertical guide locator 82 appropriately secured in the desired vertical orientation, one or more guide elements 84, 84' are preferably extended there from to a correspondingly disposed vertical guide locator 82 on an adjacent support header 30, 30', 30", 90, 90', 90", 190, 190', 190". In particular, the guide element 84, 84' may include a long strand of wire, string or other material and extends from a vertical face of the vertical guide locator 82 to a corresponding vertical face of the vertical guide locator on an adjacent support header 30, 30', 30", 90, 90', 90", 190, 190', 190". In the case of the inclusion of a pair of guide elements 84, 84', they may extend from opposite sides of the vertical guide locator 82 such that the width of the vertical guide locator 82 will generally define a width of the wall structure that is ultimately formed. Of course, it is recognized that the guide elements 84, 84' may include a single element wrapped around one or more of the vertical guide locators 82 or may include separate segments. Further, the guide elements 84, 84' may be directly adjacent the vertical side faces of the vertical guide locator 82 or may be spaced there from, such as through the use of a nail, clip, screw, etc., which provide a defined spacing from those side faces. With the guide elements 84, 84' in place, an appropriate width of the wall structure can be defined subsequent to application of the unhardened concrete, with the guide elements 84, 84' serving as a markers for the desired thickness of the wall structure, indicating how much of the concrete should be applied and/or how much of the concrete should be removed during a smoothing process. Indeed, it is also noted that while a single guide element 84 or 84' may be disposed on each side of the wall section, a series of vertically spaced guide elements 84, 84' may also be provided so as to provide an even greater degree of uniformity relative to the thickness of the finished wall section along its entire height.

In addition to the preceding structural features, it is also recognized that a variety of construction features which may be beneficial for the formation of the building structure may also be effectively integrated into the building system 10 of the present invention. For example, one or more roofing straps 47 may be effectively secured, such as to one or more of the panels 60, 62, thereby appropriately being embedded in the hardened concrete. In such an embodiment, the roofing straps 47 may merely protrude out from the span elements 40, and/or one or more slots 46 may be defined in the span element 40 for appropriate passage of the roofing straps 47 therethrough, if necessary. Additionally, as illustrated in FIG. 1, in addition to or instead of the wire loops 64, the one or more panels may be suspended from the span elements using the roofing straps 47. Specifically, a series of spaced, and often precisely spaced and sized slots 46 may be defined in the span element 40, a corresponding roofing strap 47 being extended there through. With the strap 47 preferably suspended in place at a uniform height, such as by passing a segment through one of its nail holes and allowing it to hang in place, an end of the strap 47 can include or be formed into a hook onto which the panels are suspended at a uniform height. Furthermore, in this and other embodiments a horizontal segment of rebar type reinforcement can be suspended with the panels to provide added reinforcement.

Furthermore, one or more forms and/or molds may also be suspended from the span elements 40 so as to define windows, doors and/or other openings. In particular, a panel 60, 62 may be cut, and a removable form appropriately suspended and/or disposed at a desired location for a window opening as defined by the cut. As such, once the concrete has effectively hardened around the form, the form must merely be removed and the window opening or other opening remains. Of course, it is also understood that an appropriate form may be positioned merely over a panel 60, 62, such as using the same structured used to define the span elements 40, and once the form is removed after at least partial hardening of the concrete, cutting of the panels in order to fully define the opening can be achieved.

Also, although the present structure and configuration of the various components of the present building system 10 are such that removability of the header caps 50, 50', span elements 40, connector header cap 50" and support headers 30, 30', 30", 90, 90', 90", 190, 190', 190" should be relatively easily achieved after at least partial and preferably complete hardening of the concrete to define the wall section, in some instances a lubricant type material and/or other material which prevents the concrete from hardening and/or excessively sticking thereto may also be applied to those removable elements.

From the preceding it can also be seen that the present building system 10 is especially beneficial for use during the employment of a method of constructing a multi-walled structure. Specifically, the method may include the opening of at least three, but generally a large number of holes in an underlying surface 25, and then vertically securing a rigid support 20 in each of the holes. A support header 30, 30', 30", 90, 90', 90", 190, 190', 190" having at least two engagement elements is then disposed on the exposed end 22 of each of the rigid supports 20 and a span element 40 is suspended between the adjacent support 20 at the support headers 30, 30', 30", 90, 90', 90", 190, 190', 190". With the span element(s) 40 in place, a header cap 50, 50' can be disposed thereon so as to effectively secure adjacent span elements 40 in an appropriately aligned configuration relative to one another, and a plurality of panels, including preferably a reinforcement panel 60 and an application panel 62 are suspended from the span element 40. Finally, a quantity of concrete is applied to the panels and allowed to hardened, after which the header caps, span elements and support headers may be removed for reuse as needed.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A building system comprising:

at least two vertically oriented supports, disposed in spaced relation to one another;

at least two support headers each removably connected to an exposed end of a different one of said supports;

a span element extending between adjacent ones of said support headers and including opposite ends each connected in supported relation to a different one of said support headers;

a reinforcement panel suspended from said span element, said reinforcement panel including an at least partially open structure;

an application panel suspended from said span element in overlapping relation to said reinforcement panel over at least a majority of corresponding surfaces of said reinforcement and application panels, said application panel including a plurality of apertures defined therein;

a quantity of concrete applied to said application panel in substantially covering relation to at least said application panel and said reinforcement panel and thereby defining a substantially solid wall upon hardening of said concrete, and said open structure of said reinforcement panel being dimensioned to facilitate passage of at least some of said quantity of concrete there through into said covering relation to at least said application panel.

2. A building system as recited in claim 1 wherein each of said supports include a shaft having one end inserted into an underlying surface.

3. A building system as recited in claim 1 further comprising a concrete footer structured to secure each of said supports in said vertical orientation within the underlying surface.

4. A building system as recited in claim 1 wherein each of said support headers include a mounting hub comprising a socket disposed in receiving relation to said exposed end of a corresponding one of said supports.

5. A building system as recited in claim 4 wherein said socket comprises an at least partially rounded exterior configuration structured to facilitate separation of said socket from said concrete after hardening thereof.

6. A building system as recited in claim 1 further comprising a pair of said reinforcement panels, each of said reinforcement panels suspended from said span element on opposite sides of said application panel in overlapping relation thereto over at least a majority of corresponding surfaces of said reinforcement panels and said application panel.

7. A building system as recited in claim 1 wherein at least one of said support headers comprises a recess into which said span element is removably disposed.

8. A building system as recited in claim 7 wherein said one support header comprises at least one wall element structured to at least partially define said recess and at least partially define an engagement element.

9. A building system as recited in claim 1 wherein at least one of said support headers comprises a plurality of recesses into which said span element may extend and be removably secured.

10. A building system as recited in claim 1 wherein at least one of said support headers further comprises a corner support header.

11. A building system as recited in claim 10 wherein said corner support header is removably secured to at least two adjacent ones of said span elements which extend outwardly from one another.

12. A building system as recited in claim 11 wherein said corner support header comprises at least two recesses defined therein and disposed in removable receiving relation to said adjacent ones of said span elements.

13. A building system as recited in claim 1 wherein at least one of said support headers further comprises a roof truss support header, said roof truss support header structured to support an end of said span element in a generally angled orientation.

14. A building system as recited in claim 13 wherein said roof truss support header includes an angled recess into which said span element is disposed for removable securement.

15. A building system as recited in claim 14 wherein at least one of said support headers further comprises a corner support header, said roof truss support header disposed on and extending outwardly from said corner support header.

16. A building system comprising:

at least two vertical supports disposed in spaced relation from one another;

at least two support headers each removably connected to an exposed end of a different one of said supports;

at least one span element extending between adjacent ones of said supports headers and including opposite ends connected in supported relation on a different one of said support headers;

at least two reinforcement panels suspended from said span element, said reinforcement panels including an at least partially open structure;

an application panel suspended from said span element and disposed between and in substantially overlapping relation to said two reinforcement panels over at least a majority of corresponding surfaces of said reinforcement and application panels, said application panel including a plurality of apertures defined therein; and a quantity of concrete applied from opposite sides of said application panel in substantially covering relation to said application panel and at least a corresponding one of said reinforcement panels, said concrete and said reinforcement and application panels collectively and at least partially defining a substantially solid wall upon hardening of said concrete, and said open structure of each of said reinforcement panels being dimensioned to facilitate passage of at least some of said quantity of concrete there through into said covering relation to said application panel.

17. A building system as recited in claim 16 wherein at least one of said support headers comprises a corner support header; said corner support header removably secured to at least two adjacent span elements extending outwardly from one another.

18. A building system as recited in claim 16 wherein at least one of said support headers further comprises a roof truss support header, structured to support an end of one of said span elements in a generally sloped orientation, said roof truss support header further including an angled recess into which said span element is disposed for removable securement therewith; said support header further comprising a corner support header, said roof truss support header disposed on and extending outwardly from said corner support header.

19. A building system as recited in claim 16 comprising each of said support headers and said one span element being disposed and cooperatively structured for removal from said two supports at least upon said hardening of said concrete.

20. A building system as recited in claim 16 wherein at least one of said support headers comprises a roof truss support header structured to support said one span element in a generally sloped orientation, said roof truss support header further including an angled recess into which said end of said one span element is disposed.

21. A building system as recited in claim 20 wherein at least one of said support headers comprises a corner support header and a roof truss support header, said roof truss support header connected to said corner support header and extending outwardly there from, said roof truss support header further including an angled recess into which a roof truss may be disposed for connection thereto.

* * * * *